US011736850B1

(12) United States Patent
Liu et al.

(10) Patent No.: US 11,736,850 B1
(45) Date of Patent: Aug. 22, 2023

(54) OPEN EAR HEADPHONES

(71) Applicant: Merry Electronics Co., Ltd., Taichung (TW)

(72) Inventors: Chih-Hung Liu, Taichung (TW); Ko-Min Wang, Taichung (TW); Chung-Yi Huang, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 5 days.

(21) Appl. No.: 17/715,054

(22) Filed: Apr. 7, 2022

(30) Foreign Application Priority Data

Feb. 25, 2022 (TW) ..... 111106915

(51) Int. Cl.
*H04R 25/00* (2006.01)
*H04R 1/10* (2006.01)
*H04R 1/34* (2006.01)

(52) U.S. Cl.
CPC ..... *H04R 1/1016* (2013.01); *H04R 1/105* (2013.01); *H04R 1/1066* (2013.01); *H04R 1/1091* (2013.01); *H04R 1/34* (2013.01); *H04R 2460/11* (2013.01)

(58) Field of Classification Search
CPC ..... H04R 5/04; H04R 1/1091; H04R 1/105; H04R 1/1058; H04R 1/1008; H04R 1/1025
See application file for complete search history.

(56) References Cited

U.S. PATENT DOCUMENTS

2002/0181728 A1* 12/2002 Connors ..... H04R 1/105 381/381

* cited by examiner

*Primary Examiner* — Amir H Etesam
(74) *Attorney, Agent, or Firm* — JCIPRNET

(57) ABSTRACT

Disclosed is an open ear headphone, including a housing, a speaker arranged in an accommodating space inside the housing to define the accommodating space into a front cavity and a rear cavity, a connecting member including opposite first and second ends, and a supporting member connected to the second end and including a supporting portion and a sound outlet channel. A sound outlet is provided on a surface of the housing and is in acoustic communication with the front cavity. The first end is connected to the surface of the housing. When a user wears the open ear headphone, the housing is located in a concha cavity of the user's ear, the supporting portion at least leans against a lower edge of the concha cavity, and the sound outlet channel is in acoustic communication with the user's ear canal and is not in contact with the user's ear.

14 Claims, 8 Drawing Sheets

OPEN EAR HEADPHONES

CROSS-REFERENCE TO RELATED APPLICATION

This application claims the priority benefit of Taiwanese application serial no. 111106915, filed on Feb. 25, 2022. The entirety of the above-mentioned patent application is hereby incorporated by reference herein and made a part of this specification.

BACKGROUND

Technical Field

The disclosure relates to a headphone, and particularly relates to an open ear headphone.

Description of Related Art

Generally, earplugs of an in-ear headphone may close ear canals of users, preventing disturbance of music from external sounds. However, it is thus also likely to cause uncomfortable wearing feelings of blocking, stuffing, sealing, or the like. To avoid the above uncomfortable feelings, some users may adopt a non-in-ear headphone.

For example, since ear hooks are utilized alone for wearing positioning of the non-in-ear headphone, sliding or deviating is likely to occur during vigorous exercise of the users. A position of a sound outlet of a headphone main body and a sound-outputting radial direction may also be likely to deviate because of displacement of the headphone, and thus music of a complete frequency band cannot be smoothly introduced into an ear canal receiving direction as originally determined, resulting in distortion in sound quality performance, or generating unstable feeling of the sound-outputting quality along with shaking. In addition, the ear hooks of the non-in-ear headphone are mostly attached to an outer auricle in a hanging form taking an upper part of a helix as a fulcrum. As a result, in the case of a small attaching area between skin of the user and the headphone body, the user is likely to feel a psychological sense of insecurity, worrying that the headphone may fall off or even be lost inadvertently.

SUMMARY

The disclosure is directed to an open ear headphone, which has high positioning stability when being worn by a user, and has good sound reception stability.

The disclosure provides an open ear headphone including a housing, a speaker, a connecting member and a supporting member. There is an accommodating space inside the housing, and a sound outlet is provided on a surface of the housing. The speaker is arranged in the accommodating space to define the accommodating space into a front cavity and a rear cavity. The sound outlet provided on the housing is in acoustic communication with the front cavity. The connecting member includes a first end and a second end opposite to each other. The first end of the connecting member is connected to the surface of the housing. The supporting member is connected to the second end of the connecting member, and the supporting member includes a supporting portion and a sound outlet channel. When a user wears the open ear headphone, the housing is located in a concha cavity of a ear of the user, the supporting portion of the supporting member at least leans against a lower edge of the concha cavity of the user, and the sound outlet provided on the housing and the sound outlet channel of the supporting member are in acoustic communication with a ear canal of the user, and the sound outlet provided on the housing is not in contact with the ear of the user. The lower edge of the concha cavity is defined as a lower area of an imaginary line extending in a horizontal direction from a center position of an opening of the ear canal of the user.

In an embodiment of the disclosure, the supporting portion has a first side away from the housing. When the user wears the open ear headphone, the first side of the supporting portion corresponds to the opening of the ear canal of the user, and incompletely masks the opening of the ear canal through the sound outlet channel.

In an embodiment of the disclosure, the supporting portion has a second side facing the housing, the supporting portion surrounds the sound outlet channel, and the sound outlet channel penetrates the first side and the second side of the supporting portion.

In an embodiment of the disclosure, a sound output by the speaker sequentially passes through the sound outlet provided on the housing, the second side of the supporting portion, the first side of the supporting portion, and the opening of the ear canal.

In an embodiment of the disclosure, an opening width of the first side of the supporting portion is equal to an opening width of the second side of the supporting portion.

In an embodiment of the disclosure, an opening width of the first side of the supporting portion is smaller than an opening width of the second side of the supporting portion.

In an embodiment of the disclosure, the open ear headphone further includes an auxiliary positioning member, which is connected to the housing, and configured to be clipped on a part of the ear of the user.

In an embodiment of the disclosure, when the user wears the open ear headphone, the auxiliary positioning member and an auricle contact surface of the user generate a force in a first direction, and the supporting member and the housing jointly contact the concha cavity of the user to generate a force in a second direction, where the first direction is opposite to the second direction.

In an embodiment of the disclosure, the supporting portion has a closed ring shape.

In an embodiment of the disclosure, the supporting portion has a non-closed ring shape.

In an embodiment of the disclosure, the supporting portion of the supporting member has a first supporting edge and a second supporting edge, the first supporting edge leans against an upper edge of the concha cavity, and the second supporting edge leans against the lower edge of the concha cavity.

In an embodiment of the disclosure, an orthogonal axis of a midpoint position on an imaginary connection line between the first supporting edge and the second supporting edge of the supporting portion is defined as a first axial direction, the first axial direction is parallel to a sound outlet direction of the sound outlet channel, an orthogonal axis of a midpoint position on an imaginary connection line between a first inner edge and a second inner edge of the sound outlet is defined as a second axial direction, and the first axial direction of the supporting portion is parallel to the second axial direction of the sound outlet; or an included angle between the first axial direction of the supporting portion and the second axial direction of the sound outlet is between 0° and 45°.

In an embodiment of the disclosure, the sound outlet and the sound outlet channel are aligned with the ear canal of the user, and there is no masking between the sound outlet and the sound outlet channel.

Based on the above description, in the open ear headphone of the disclosure, the housing is located in the concha cavity of the ear of the user, and the supporting portion of the supporting member at least leans against the lower edge of the concha cavity of the user to maintain a relative position of the sound outlet and the ear canal, such that headphone music may pass through the sound outlet channel of the supporting member according to a specific path and is smoothly transmitted to the ear canal of the user.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
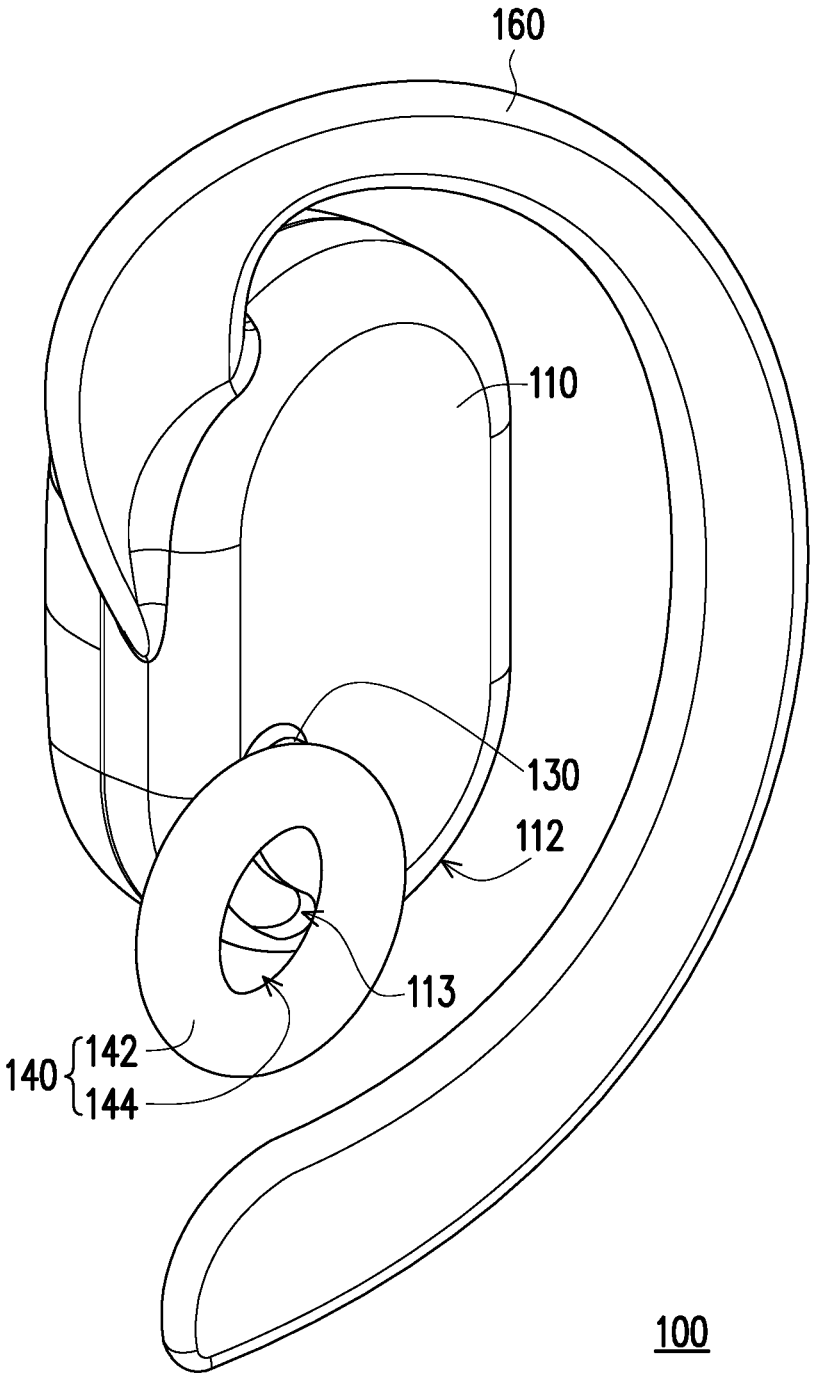
FIG. 1 is a schematic three-dimensional view of an open ear headphone according to an embodiment of the disclosure.
Figure 2:
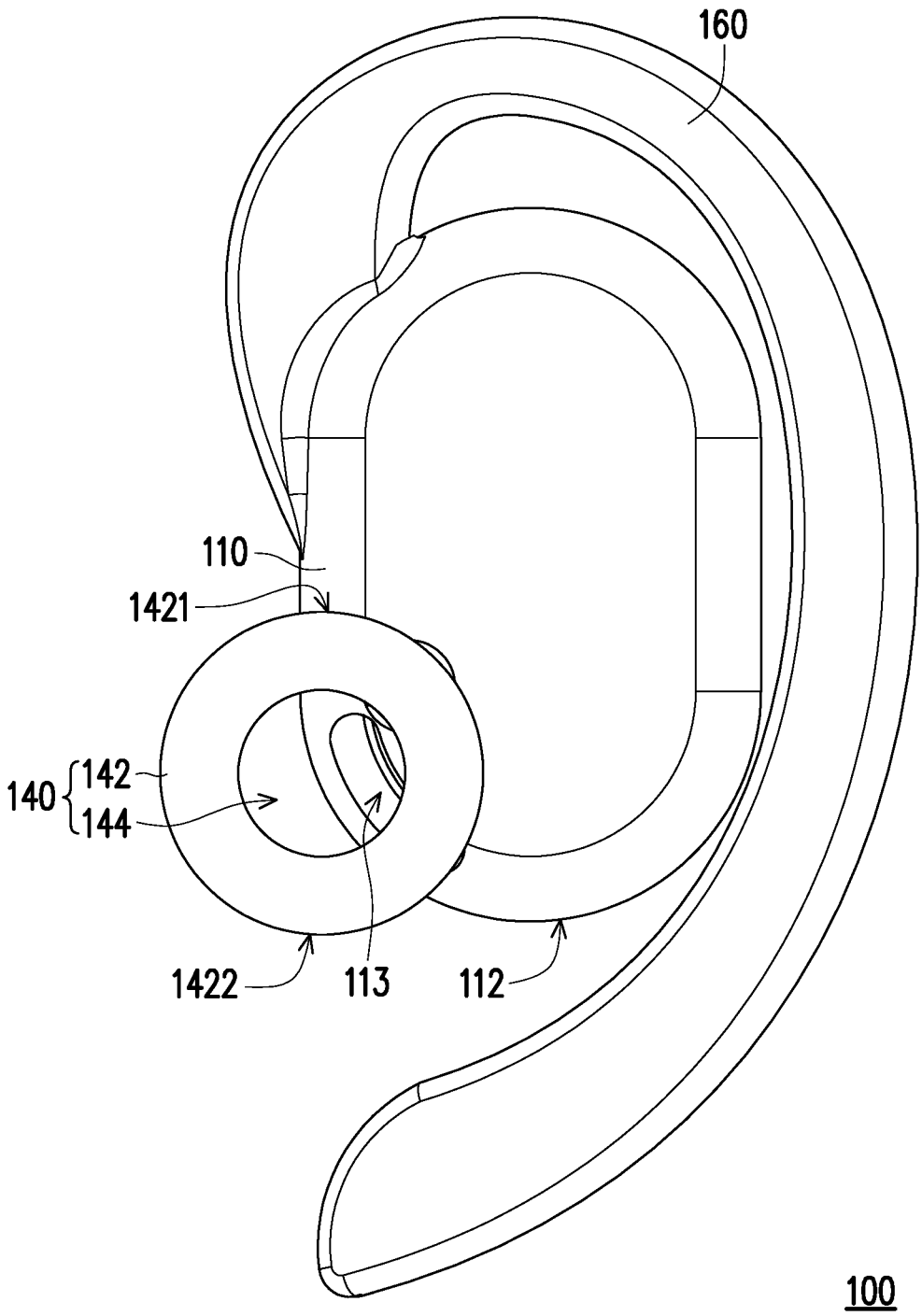
FIG. 2 is a schematic side view of the open ear headphone of FIG. 1.

FIG. 1 is a schematic three-dimensional view of an open ear headphone according to an embodiment of the disclosure. FIG. 2 is a schematic side view of the open ear headphone of FIG. 1. Referring to FIG. 1 and FIG. 2, an open ear headphone 100 of the embodiment includes a housing 110, a connecting member 130 and a supporting member 140. It should be noted that, in fact, the headphones are a pair, but since components of the right and left ear headphones are actually the same, in the following description the right ear headphone is taken as an example for description.

Figure 3:
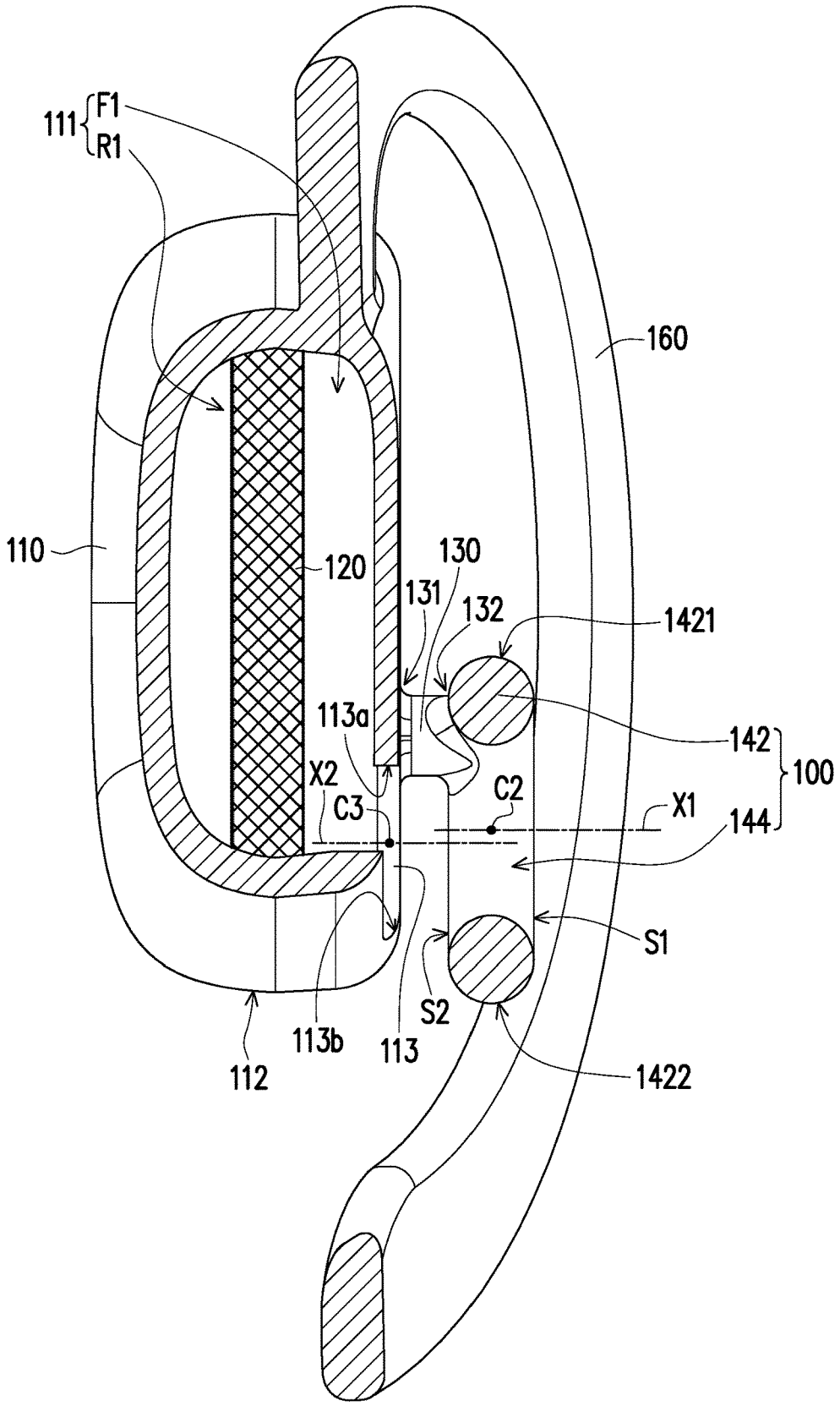
FIG. 3 is a schematic cross-sectional view of the open ear headphone of FIG. 1.

FIG. 3 is a schematic cross-sectional view of the open ear headphone of FIG. 1. Referring to FIG. 3, in the embodiment, the connecting member 130 is located between the housing 110 and the supporting member 140. The connecting member 130 includes a first end 131 and a second end 132 that are opposite to each other. The first end 131 of the connecting member 130 is connected to a surface of the housing 110. The supporting member 140 is connected to the second end 132 of the connecting member 130. In the embodiment, the supporting member 140 is fixed to the housing 110 through the connecting member 130, but in other embodiments, the supporting member and the housing may be connected by other suitable structures or methods, which are not limited by the disclosure.

In detail, in the embodiment, there is an accommodating space 111 inside the housing 110, and a sound outlet 113 is provided on a surface of the housing 110. The open ear headphone 100 further includes a speaker 120. The speaker 120 is arranged in the accommodating space 111 to define the accommodating space 111 into a front cavity F1 and a rear cavity R1. The sound generated by the speaker 120 may be output through the sound outlet 113 provided on the housing 110. The sound outlet 113 provided on the housing 110 is in acoustic communication with the front cavity F1.

Figure 4A:
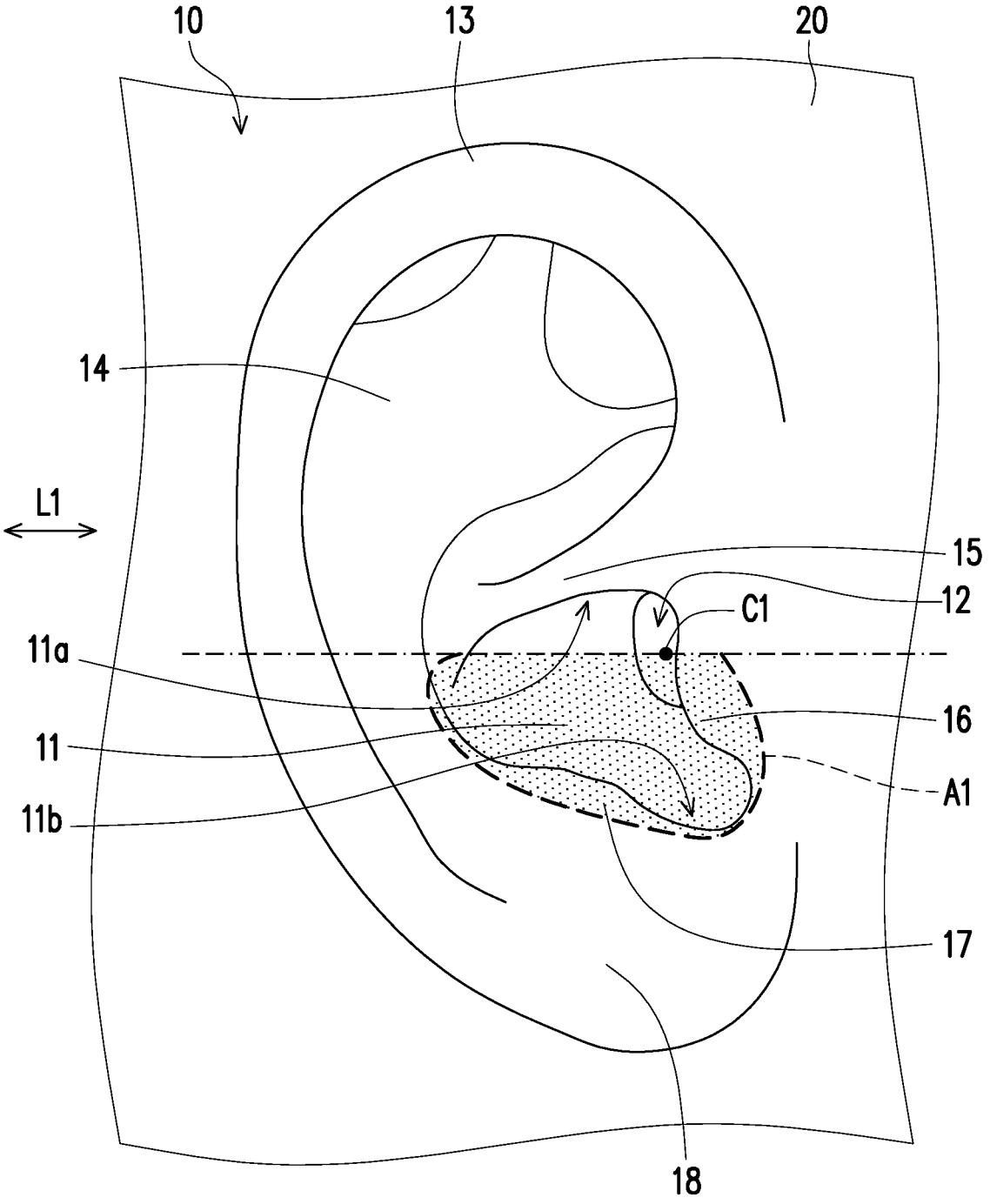
FIG. 4A is a schematic diagram of an ear of a user.
Figure 4B:
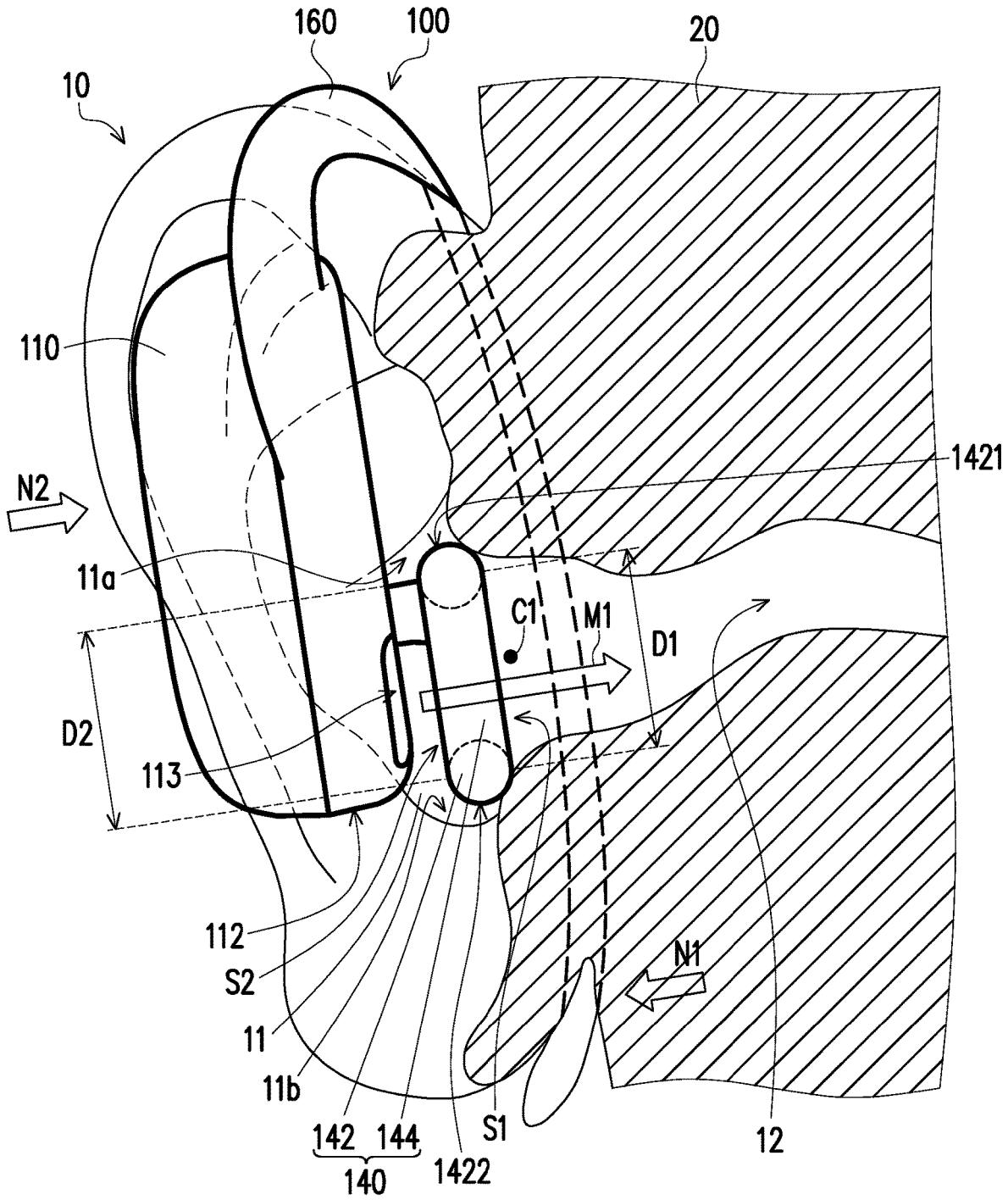
FIG. 4B is a schematic diagram of wearing the open ear headphone of FIG. 1.

FIG. 4A is a schematic diagram of an ear of a user. FIG. 4B is a schematic diagram of wearing the open ear headphone of FIG. 1. Referring to FIG. 4A, in the embodiment, an ear of a user 20 has structures such as a concha cavity 11, an ear canal 12, a helix 13, an antihelix 14, a helix crus 15, a tragus 16, an antitragus 17, and an earlobe 18. In the embodiment, a lower edge 11*b* of the concha cavity 11 is defined as a lower area A1 of an imaginary line extending in a horizontal direction L1 from a center position C1 of an opening of the ear canal 12 of the user 20. Referring to FIG. 4B, in the embodiment, when the user 20 wears the open ear headphone 100, the housing 110 is located in the concha cavity 11 of the ear 10 of the user 20. Here, an outer shape of the housing 110 is an egg shape, and a lower end portion 112 of the housing 110 is arc-shaped, so as to be in a clamping or supporting fixed relationship with the lower edge 11*b* of the concha cavity 11 of an outer auricle of the user 20, thereby enhancing the stability of the housing 110 attached to the ear 10 of the user 20, but the disclosure is not limited thereto.

In the embodiment, the supporting member 140 includes a supporting portion 142 and a sound outlet channel 144. The supporting portion 142 of the supporting member 140 at least leans against the lower edge 11*b* of the concha cavity of the user, but the disclosure is not limited thereto.

In the embodiment, the sound outlet 113 of the housing 110 and the sound outlet channel 144 of the supporting member 140 are in acoustic communication with the ear canal 12 of the user 20, and the sound outlet 113 of the housing 110 does not contact the ear 10 of the user 20. There is air in the sound outlet channel 144, and the sound generated by the speaker 120 is transmitted through the air serving as a medium. The supporting portion 142 of the supporting member 140 provides a positioning effect, and separates the sound outlet 113 from the ear 10 of the user 20, so that the sound outlet 113 does not directly contact the ear 10 of the user 20.

Under the above configuration, the open ear headphone 100 of the embodiment utilizes the housing 110 to be located in the concha cavity 11, and the supporting portion 142 of the supporting member 140 at least leans against the lower edge 11*b* of the concha cavity 11 to maintain a relative position of the sound outlet 113 of the housing 110 and the ear canal 12, such that the music of the open ear headphone 100 may pass through the sound outlet channel 144 of the supporting member 140 according to a specific path, and is smoothly transmitted to the ear canal 12 of the user 20, so as to enhance positioning stability when the user 20 wears the open ear headphone 100, and achieve good sound reception stability.

To be specific, referring to FIG. 2, in the embodiment, the supporting portion 142 of the supporting member 140 has a closed ring shape. For example, the supporting portion 142 is in the shape of a circular ring, so as to form the sound outlet channel 144. In other embodiments, the supporting portion may also have other appropriate shapes to correspond to the concha cavity of the ear of the user, which is not limited by the disclosure.

In the embodiment, the supporting portion 142 of the supporting member 140 has a first supporting edge 1421 and a second supporting edge 1422. Referring to FIG. 4B, the first supporting edge 1421 leans against an upper edge 11*a* of the concha cavity 11, and the second supporting edge 1422 leans against the lower edge 11*b* of the concha cavity 11. Since the supporting member 140 mainly leans against the concha cavity 11, it may limit and ensure that the sound outlet 113 provided on the housing 110 and the center position C1 of the opening of the ear canal 12 maintain a relative positional relationship, so that a sound output from the speaker 120 may be transmitted according to a specific path axial direction M1, and passes through the sound outlet channel 144 of the supporting member 140 for being smoothly transmitted to the ear canal 12.

In the embodiment, the supporting portion 142 has a first side S1 away from the housing 110. Specifically, when the user 20 wears the open ear headphone 100, the first side S1 of the supporting portion 142 corresponds to the opening of the ear canal 12 of the user 20, and incompletely masks the opening of the ear canal 12 the sound outlet channel 144. The supporting portion 142 has a second side S2 facing the housing 110, the supporting portion 142 surrounds the sound outlet channel 144, and the sound outlet channel 144 penetrates the first side S1 and the second side S2 of the supporting portion 142. In the embodiment, from the sound outlet 113 provided on the housing 110, the sound output by the speaker 120 sequentially passes through the second side S2 of the supporting portion 142, the sound outlet channel 144 and the first side S1 of the supporting portion 142 to reach the ear canal 12.

In the embodiment, the sound outlet 113 and the sound outlet channel 144 are aligned with the ear canal 12 of the user 20, and there is no masking between the sound outlet 113 and the sound outlet channel 144. The masking is, for example, a baffle, a mesh or other components, but the disclosure is not limited thereto.

In the embodiment, an opening width D1 of the first side S1 of the supporting portion 142 is equal to an opening width D2 of the second side S2 of the supporting portion 142, but the disclosure is not limited thereto.

Further, referring to FIG. 1 and FIG. 4B, the open ear headphone 100 further includes an auxiliary positioning member 160, and the auxiliary positioning member 160 is connected to the housing 110, and is configured to be clipped on a part of the ear 10 of the user 20. The auxiliary positioning member 160 is, for example, an ear hook. In the embodiment, the auxiliary positioning member 160 is suitable for leaning against a connection portion between the ear 10 and the head of the user 20, but the disclosure is not limited thereto. In an embodiment, the auxiliary positioning member 160 is made of an elastic material, but the disclosure is not limited thereto.

Referring to FIG. 4B, in the embodiment, when the user 20 wears the open ear headphone 100, the auxiliary positioning member 160 and an auricle contact surface of the user generate a force in a first direction N1, and the supporting member 140 and the housing 110 jointly contact the concha cavity 11 of the user 20 to generate a force in a second direction N2, where the first direction N1 is opposite to the second direction N2 to form a bidirectional force applying relationship. In addition, since an attaching area between the skin of the user 20 and the open ear headphone 100 is increased, a psychological feeling of the user may have a sense of security.

In the embodiment, an axial direction of the supporting portion 142 is parallel to an axial direction of the sound outlet 113. To be specific, as shown in the cross-sectional view of FIG. 3, in the embodiment, an orthogonal axis of a midpoint position C2 on an imaginary connection line between the first supporting edge 1421 and the second supporting edge 1422 of the supporting portion 142 is defined as a first axial direction X1, and the first axial direction X1 is parallel to a sound outlet direction of the sound outlet channel 144. As shown in the cross-sectional view of FIG. 3, in the embodiment, an orthogonal axis of a midpoint position C3 on an imaginary connection line between a first inner edge 113*a* and a second inner edge 113*b* of the sound outlet 113 is defined as a second axial direction X2, and the second axial direction X2 is parallel to the sound outlet direction of the sound outlet channel 144. In the embodiment, the first axial direction X1 of the supporting portion 142 is parallel to the second axial direction X2 of the sound outlet 113. Namely, an included angle between the first axial direction X1 and the second axial direction X2 is 0° or between 0° and 45°, but the disclosure is not limited thereto.

It should be noticed that reference numbers of the components and a part of contents of the aforementioned embodiment are also used in the following embodiment, where the same reference numbers denote the same or like components, and descriptions of the same technical contents are omitted. The aforementioned embodiment may be referred for descriptions of the omitted parts, and detailed descriptions thereof are not repeated in the following embodiment.

Figure 5:
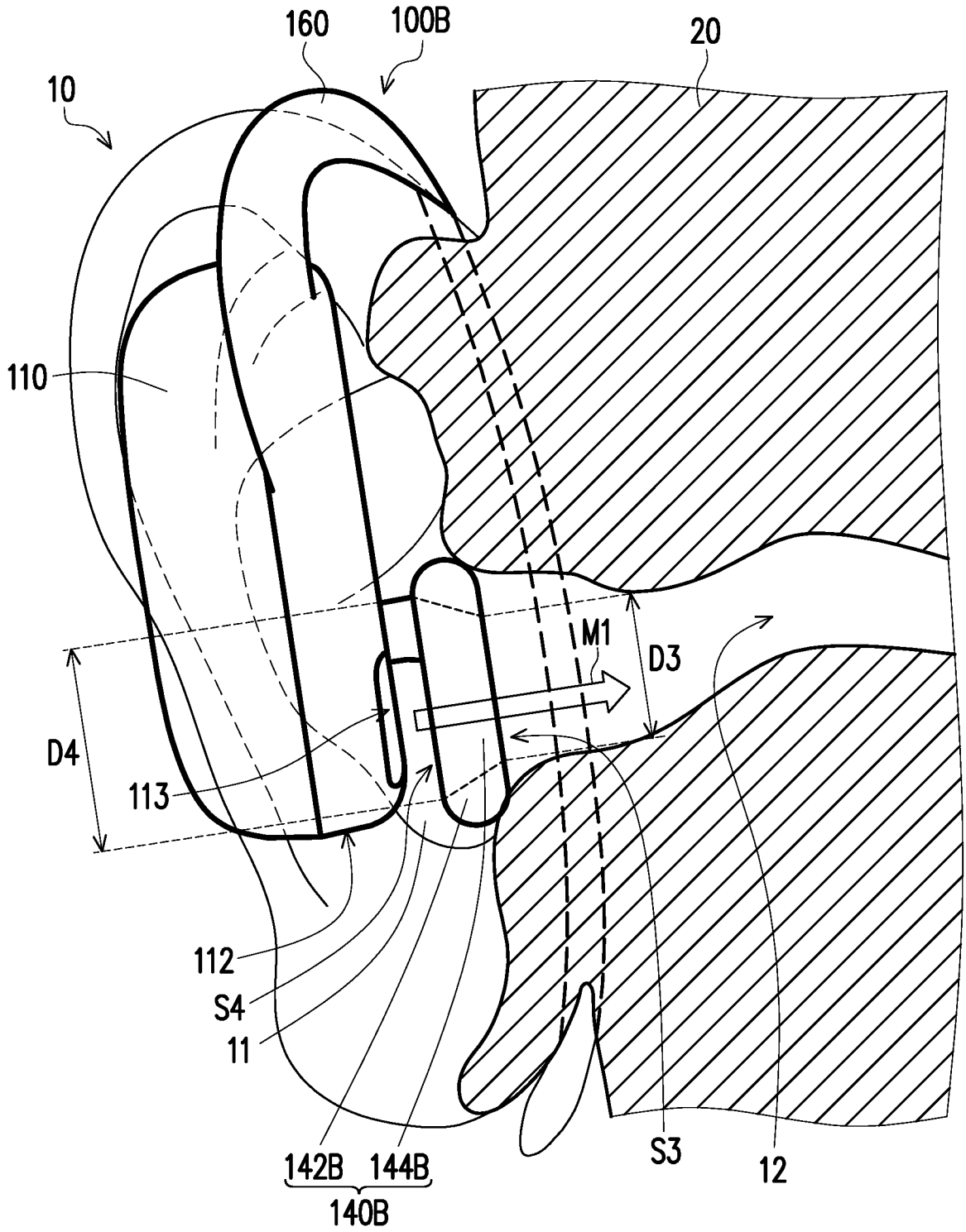
FIG. 5 is a schematic front cross-sectional view of a user wearing an open ear headphone according to another embodiment of the disclosure.

FIG. 5 is a schematic front cross-sectional view of a user wearing an open ear headphone according to another embodiment of the disclosure. Referring to FIG. 5, in the embodiment, an open ear headphone 100B is slightly different from the open ear headphone 100 of FIG. 4B, and the main difference is that an opening width D3 of a first side S3 of a supporting portion 142B is smaller than an opening width D4 of a second side S4 of the supporting portion 142B, namely, an inner diameter of a sound outlet channel 144B of a supporting member 140B is decreased from an interior close to the housing 110 toward a distal end, but the disclosure is not limited thereto. In other embodiments, an acoustic characteristic of the sound after passing through the supporting member may be changed by changing a cross section design, a material of the parts, a surface treatment of the supporting portion or through other suitable methods, so as to increase the possibility of tuning, which is not limited in the disclosure.

Figure 6:
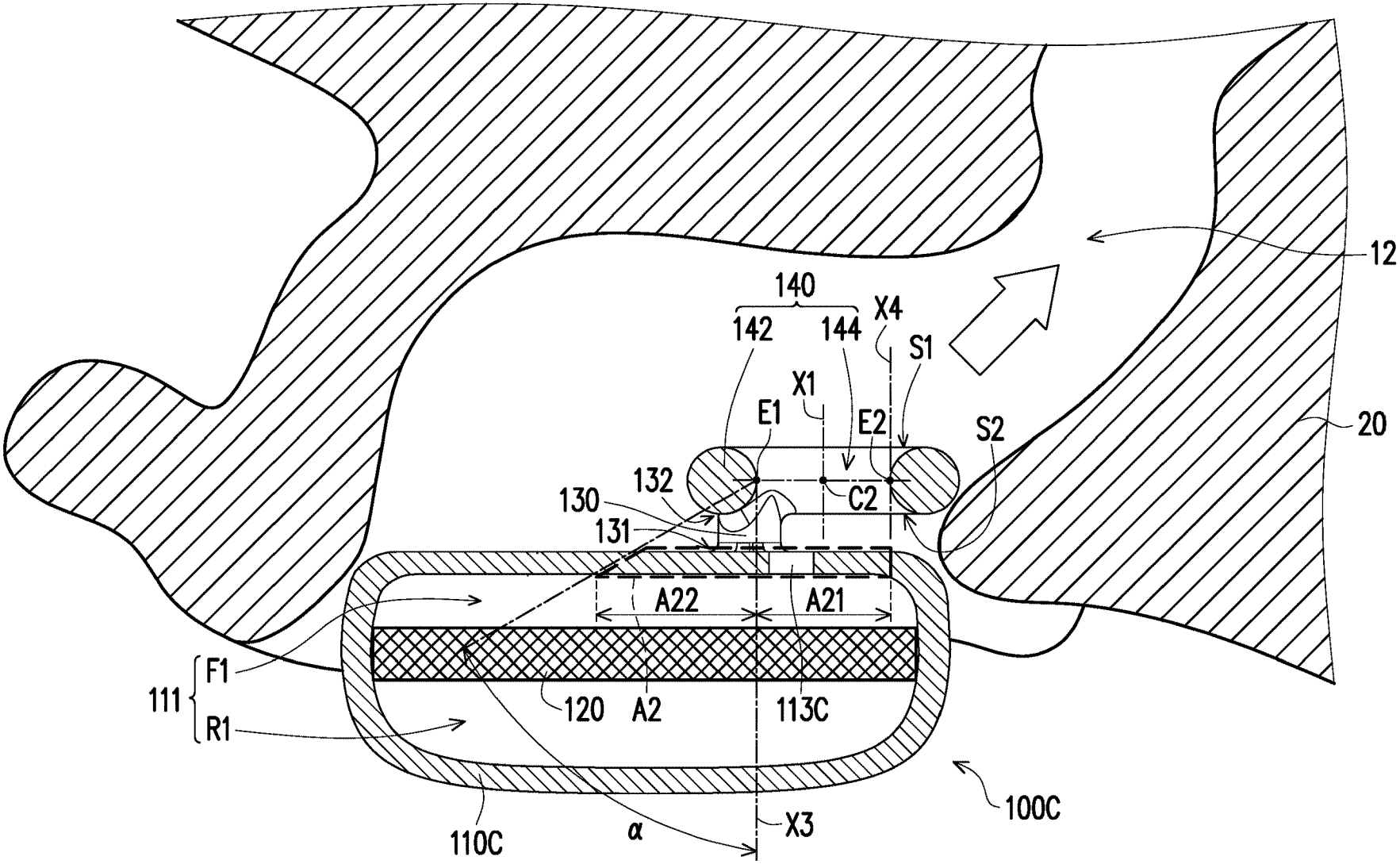
FIG. 6 is a schematic top cross-sectional view of a user wearing an open ear headphone according to another embodiment of the disclosure.

FIG. 6 is a schematic top cross-sectional view of a user wearing an open ear headphone according to another embodiment of the disclosure. Referring to FIG. 6, in the embodiment, a position of a sound outlet 113C provided on a housing 110C is located in an area A2, and the area A2 includes an area A21 and an area A22.

The open ear headphone in FIG. 6 is worn on the right ear of the user. In an embodiment, the sound outlet 113C is located in the area A21, a supporting portion 142C is defined with inner edges E1 and E2, and a tangent line passing through the inner edge E1 of the supporting portion 142C is defined as a third axial direction X3, and the third axial direction X3 is parallel to the first axial direction X1. A tangent line passing through the inner edge E2 of the supporting portion 142C is defined as a fourth axial direction X4, and the fourth axial direction X4 is parallel to the first axial direction X1. The area A21 is an area corresponding to the housing 110C between the third axial direction X3 and the fourth axial direction X4; or the sound outlet 113C may also be located in the area A22, and the area A22 is an area where the third axial direction X3 corresponds to the housing 110C when the third axial direction X3 rotates 60 degrees clockwise at an intersection of the inner edge E1 and an imaginary connection line between the inner edge E1 and the inner edge E2. The sound outlet 113C is suitable for being arranged in the area A2, so that the sound conduction path may enter the ear canal 12 at an optimal ergonomic angle when passing through the midpoint position C2 of the supporting member 140. In other embodiments, as long as the sound of the speaker may directly pass through the supporting member to reach the ear canal from the sound outlet provided on the housing, it is considered to be within the scope of the disclosure.

Figure 7C:
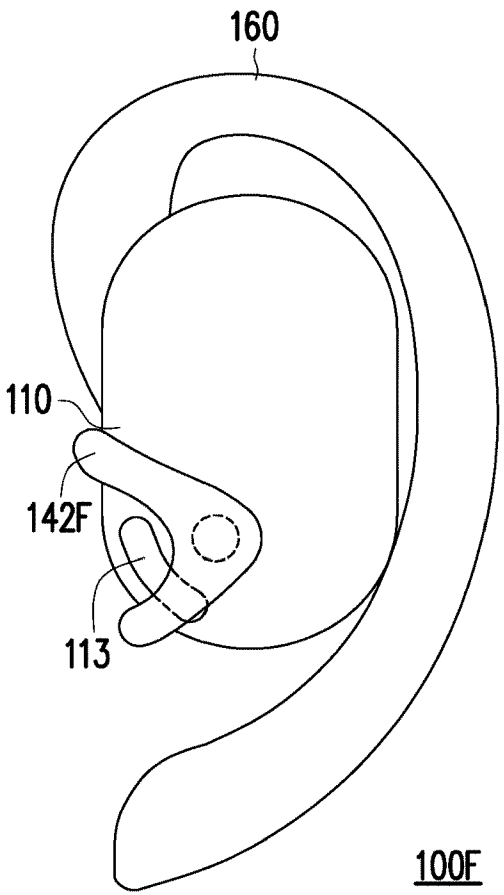
FIG. 7A-FIG. 7C are schematic diagrams of open ear headphones according to other embodiments of the disclosure.
Figure 7B:
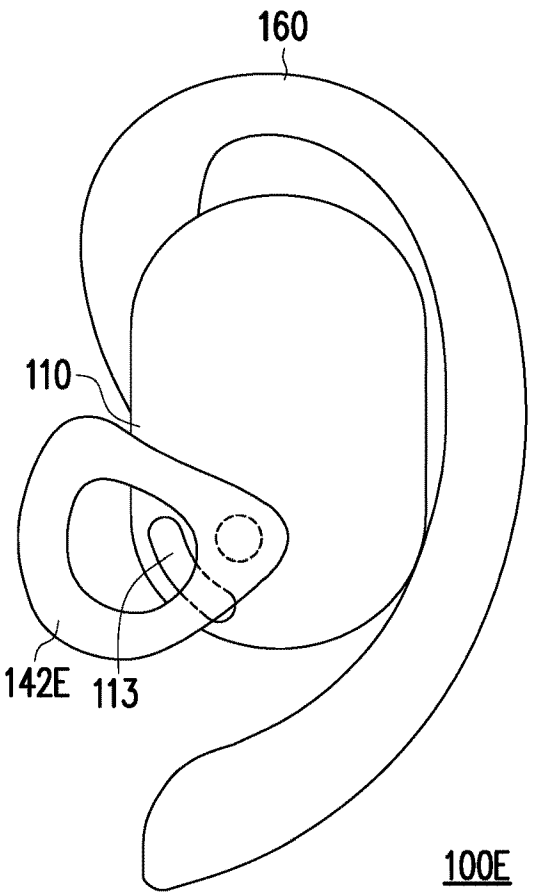
Figure 7A:
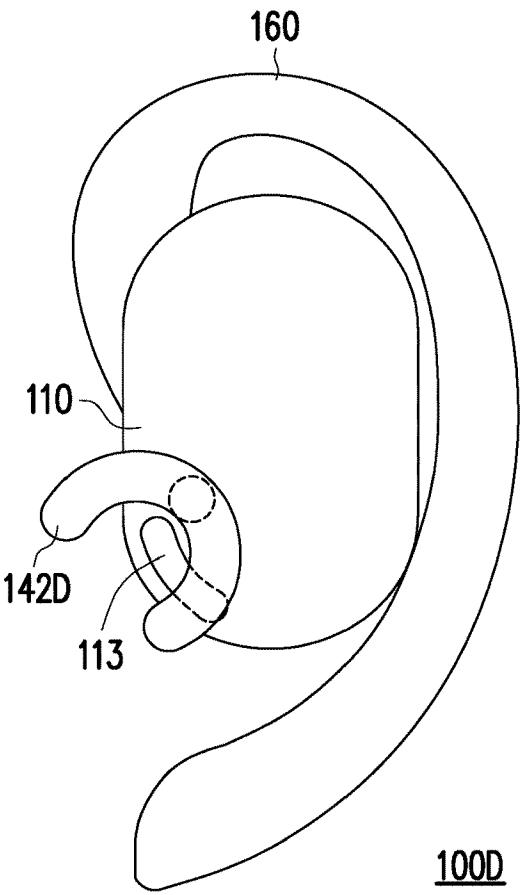

FIG. 7A to FIG. 7C are schematic diagrams of open ear headphones according to other embodiments of the disclosure. Referring to FIG. 7A first, in the embodiment, an open ear headphone 100D is slightly different from the open ear headphone 100 of FIG. 2, and a main difference there between lies in a shape of a supporting portion 142D. The supporting portion 142D of the open ear headphone 100D has a non-closed ring shape, specifically, the supporting portion 142D has a semi-closed ring shape.

Referring to FIG. 7B, in the embodiment, a supporting portion 142E of an open ear headphone 100E has a closed irregular shape.

Referring to FIG. 7C, in the embodiment, a supporting portion 142F of an open ear headphone 100F has a semi-closed irregular shape.

In addition, in the above-mentioned embodiments of FIG. 1, FIG. 5, FIG. 6, and FIG. 7A to FIG. 7C, additional perforations or partial hollowing may also be added to the supporting portion, which is not limited by the disclosure, as long as it is suitable for the user to wear, and the sound outlet of the housing may be in acoustic communication with the ear canal of the user, it is considered to be within a protection scope of the disclosure.

In summary, in the open ear headphone of the disclosure, the housing is located in the concha cavity of the ear of the user, and the supporting portion of the supporting member at least leans against the lower edge of the concha cavity of the user to maintain a relative position of the sound outlet and the ear canal, such that headphone music may pass through the sound outlet channel of the supporting member according to a specific path and is smoothly transmitted to the ear canal of the user, so as to accurately maintain the specific relative relationship between the sound outlet and the concha cavity without cause uncomfortable wearing feeling of blocking, stuffing, sealing, or the like. In addition, through a clamping force generated in a specific direction by the auxiliary positioning member and the auricle contact surface, in collaboration with a supporting surface of the supporting member in the concha cavity and a clamping force generated in an opposite direction by the lower end portion of the housing and a supporting surface of the lower edge of the concha cavity of the outer auricle, the three parts form a bidirectional force applying relationship, so as to achieve high positioning stability when the user wears the open ear headphone, and achieve good sound reception stability.

It will be apparent to those skilled in the art that various modifications and variations can be made to the disclosed embodiments without departing from the scope or spirit of the disclosure. In view of the foregoing, it is intended that the disclosure covers modifications and variations provided they fall within the scope of the following claims and their equivalents.

What is claimed is:

1. An open ear headphone, comprising:

a housing, wherein there is an accommodating space inside the housing, and a sound outlet is provided on a surface of the housing;

a speaker, arranged in the accommodating space to define the accommodating space into a front cavity and a rear cavity, wherein the sound outlet provided on the housing is in acoustic communication with the front cavity;

a connecting member, comprising a first end and a second end opposite to each other, wherein the first end of the connecting member is connected to the surface of the housing; and a supporting member, connected to the second end of the connecting member, and the supporting member comprising a supporting portion and a sound outlet channel, wherein when a user wears the open ear headphone, the housing is located in a concha cavity of a ear of the user, the supporting portion of the supporting member at least leans against a lower edge of the concha cavity of the user, the sound outlet provided on the housing and the sound outlet channel of the supporting member are in acoustic communication with a ear canal of the user, the sound outlet provided on the housing is not in contact with the ear of the user, and the lower edge of the concha cavity is defined as a lower area of an imaginary line extending in a horizontal direction from a center position of an opening of the ear canal of the user.

2. The open ear headphone as claimed in claim 1, wherein the supporting portion has a first side away from the housing, and when the user wears the open ear headphone, the first side of the supporting portion corresponds to the opening of the ear canal of the user, and incompletely masks the opening of the ear canal through the sound outlet channel.

3. The open ear headphone as claimed in claim 2, wherein the supporting portion has a second side facing the housing, the supporting portion surrounds the sound outlet channel, and the sound outlet channel penetrates the first side and the second side of the supporting portion.

4. The open ear headphone as claimed in claim 3, wherein a sound output by the speaker sequentially passes through the sound outlet provided on the housing, the second side of the supporting portion, the first side of the supporting portion, and the opening of the ear canal.

5. The open ear headphone as claimed in claim 3, wherein an opening width of the first side of the supporting portion is equal to an opening width of the second side of the supporting portion.

6. The open ear headphone as claimed in claim 3, wherein an opening width of the first side of the supporting portion is smaller than an opening width of the second side of the supporting portion.

7. The open ear headphone as claimed in claim 1, further comprising an auxiliary positioning member, wherein the auxiliary positioning member is connected to the housing, and configured to be clipped on a part of the ear of the user.

8. The open ear headphone as claimed in claim 7, wherein when the user wears the open ear headphone, the auxiliary positioning member and an auricle contact surface of the user generate a force in a first direction, and the supporting member and the housing jointly contact the concha cavity of the user to generate a force in a second direction, wherein the first direction is opposite to the second direction.

9. The open ear headphone as claimed in claim 1, wherein the supporting portion has a closed ring shape.

10. The open ear headphone as claimed in claim 1, wherein the supporting portion has a non-closed ring shape.

11. The open ear headphone as claimed in claim 1, wherein the supporting portion of the supporting member has a first supporting edge and a second supporting edge, the first supporting edge leans against an upper edge of the concha cavity, and the second supporting edge leans against the lower edge of the concha cavity.

12. The open ear headphone as claimed in claim 11, wherein an orthogonal axis of a midpoint position on an imaginary connection line between the first supporting edge and the second supporting edge of the supporting portion is defined as a first axial direction, the first axial direction is parallel to a sound outlet direction of the sound outlet channel, an orthogonal axis of a midpoint position on an imaginary connection line between a first inner edge and a second inner edge of the sound outlet is defined as a second axial direction, and the first axial direction of the supporting portion is parallel to the second axial direction of the sound outlet.

13. The open ear headphone as claimed in claim 11, wherein an orthogonal axis of a midpoint position on an imaginary connection line between the first supporting edge and the second supporting edge of the supporting portion is defined as a first axial direction, the first axial direction is parallel to a sound outlet direction of the sound outlet channel, an orthogonal axis of a midpoint position on an imaginary connection line between a first inner edge and a second inner edge of the sound outlet is defined as a second axial direction, and an included angle between the first axial direction of the supporting portion and the second axial direction of the sound outlet is between 0° and 45°.

14. The open ear headphone as claimed in claim 1, wherein the sound outlet and the sound outlet channel are aligned with the ear canal of the user, and there is no masking between the sound outlet and the sound outlet channel.

* * * * *